US005718072A

United States Patent [19]

Garfinkle

[11] Patent Number: 5,718,072

[45] Date of Patent: Feb. 17, 1998

[54] SIGN SYSTEM

[76] Inventor: Benjamin L. Garfinkle, 1120 Portal Ave., Piedmont, Calif. 94610

[21] Appl. No.: 310,221

[22] Filed: Sep. 21, 1994

Related U.S. Application Data

[63] Continuation of Ser. No. 859,051, Mar. 27, 1992, abandoned.

[51] Int. Cl.[6] ..... G09F 7/00

[52] U.S. Cl. ..... 40/606; 40/611

[58] Field of Search ..... 40/606, 617, 605, 40/611; 248/284, 225.1, 307; 403/300, 306, 194, 187

[56] References Cited

U.S. PATENT DOCUMENTS

| | | | |
|---|---|---|---|
| 1,480,606 | 1/1924 | Fetters | 40/605 |
| 1,964,484 | 6/1934 | Schroeder . | |
| 2,006,573 | 7/1935 | Isenhour . | |
| 2,548,027 | 4/1951 | Kincaid | 248/289 |
| 2,927,701 | 3/1960 | Lynde, Jr. | 248/307 |
| 3,154,870 | 11/1964 | Hopp et al. | 40/611 |
| 3,598,349 | 8/1971 | Drake | 403/292 |
| 3,900,269 | 8/1975 | Parlot | 40/292 |
| 3,930,327 | 1/1976 | Friedman . | |
| 3,969,838 | 7/1976 | Moore . | |
| 4,327,514 | 5/1982 | Bourgue | 40/617 |
| 4,344,244 | 8/1982 | Tyke | 40/611 |
| 4,641,448 | 2/1987 | Cobb et al. | 40/617 |
| 4,753,026 | 6/1988 | Woodman et al. . | |
| 5,090,145 | 2/1992 | Chiang et al. | 40/617 |
| 5,186,428 | 2/1993 | Falkenberg | 248/284 |

*Primary Examiner*—Kenneth J. Dorner
*Assistant Examiner*—Cassandra Davis
*Attorney, Agent, or Firm*—Malcolm B. Wittenberg

[57] ABSTRACT

A sign system having one or more rail sections which are characterized as having substantially uniform cross-sections and longitudinal axis with indents configured within the rail system for accepting protrusions located on sign holder bases. The cross-sections of each rail section are characterized as having an open region for accepting connectors for connecting the rail sections to support elements. Body portions are provided for retaining the connectors as well.

16 Claims, 4 Drawing Sheets

SIGN SYSTEM

This is a continuation of application Ser. No. 07/859,051 which was fled on Mar. 27, 1992, now abandoned.

TECHNICAL FIELD OF THE INVENTION

The present invention relates to signs and sign systems.

BACKGROUND OF THE INVENTION

Supermarkets and like environments present unique signage display problems. These unique problems are a result of the necessity to display widely diverse consumer related products such as produce, meat and cheese goods, as well as paper and canned goods while using a single universal sign system. The displays must be not only attractive to customers but must also clearly convey product identification and pricing information.

Unique within the supermarket environment is the refrigerated display case which includes canopy hardware. This configuration generally requires that product identifying and pricing information be presented above and in conjunction with articles of produce and the like, generally at eye level. The signage system must be configured in conjunction with the refrigerated case canopy so as to enable the display case to present as much product for sale as possible while not interfering with customer inspection. In addition, it is critical that the signage be capable of being readily changed as products themselves change within the case and pricing of preexisting products fluctuates. Such a typical display environment is shown in FIG. 1 whereby rows of produce are presented below canopy 6.

Consumable products are oftentimes also displayed in a non-refrigerated environment such as shown in FIG. 2. In this instance, produce 7 is stacked in a pyramid-like fashion requiring pricing information to be readily presented at consumer's eye level.

Unfortunately, apart from the present invention, there has not been a universally acceptable signage system which can be employed in the diverse environments shown in FIGS. 1 and 2.

It is thus an object of the present invention to provide a signage system capable of being employed within a supermarket environment, universally, with minor modification from service area to service area.

It is a further object of the present invention to provide a universally acceptable signage system capable of being employed both in a canopied refrigerated case as well as a non-refrigerated stacked product configuration.

These and further objects of the present invention will be more readily appreciated when considering the following description and the appended claims wherein:

Figure 1:
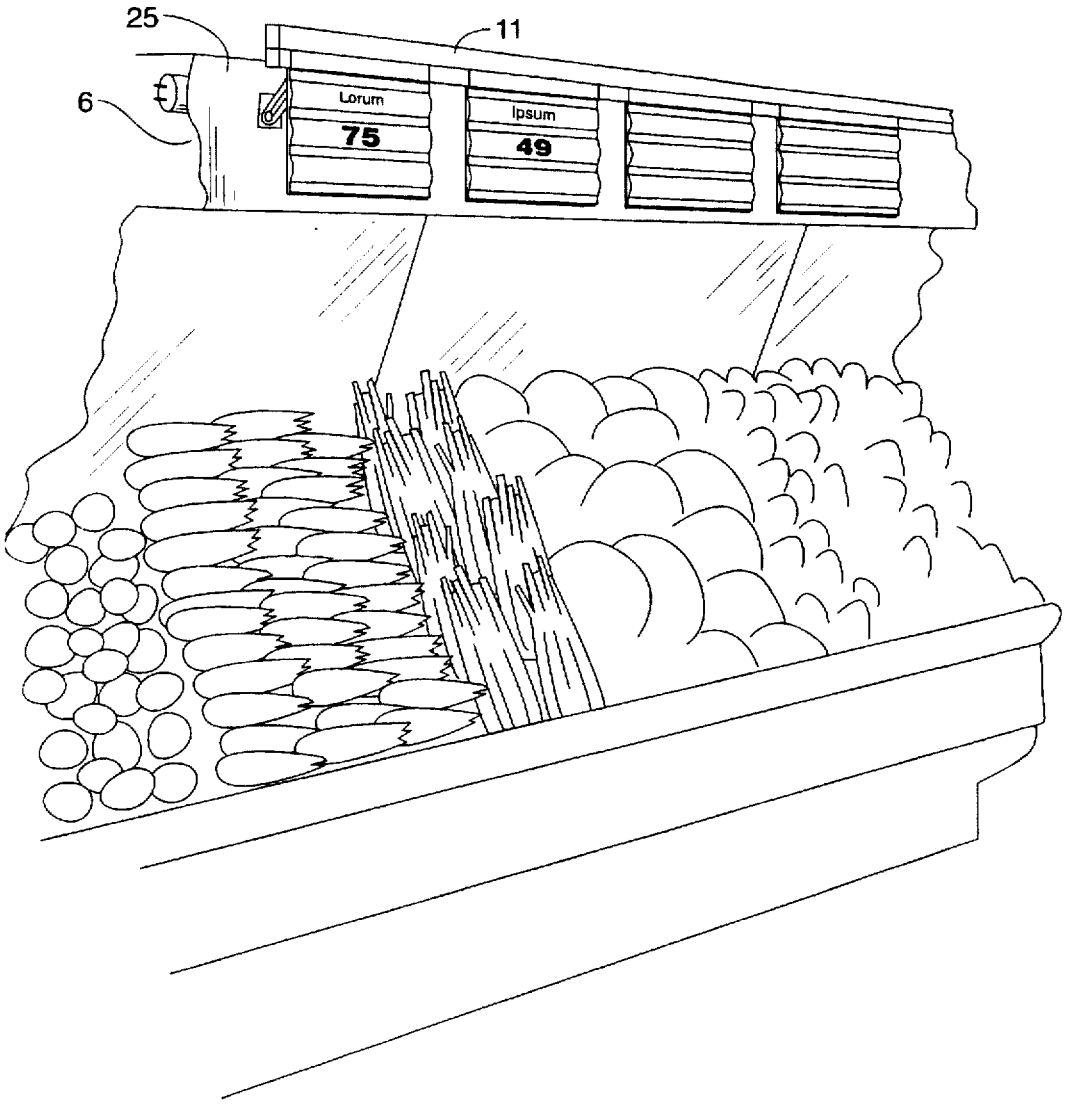
FIG. 1 is a depiction of a typical canopied refrigerated case found in modern supermarkets.
Figure 2:
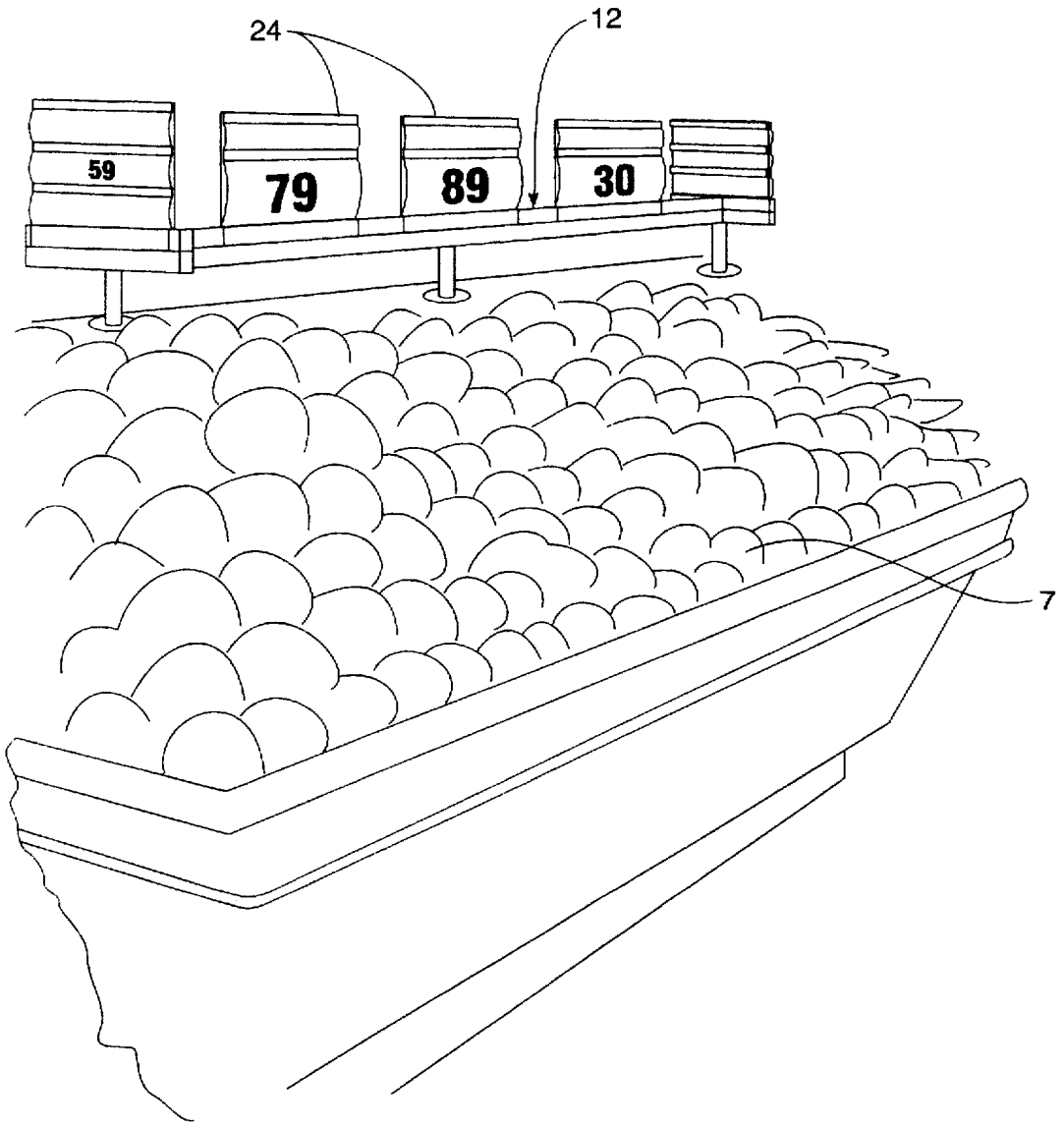
FIG. 2 is an illustration of a typical non-refrigerated case displaying a pyramid stack of produce.
Figure 4A:
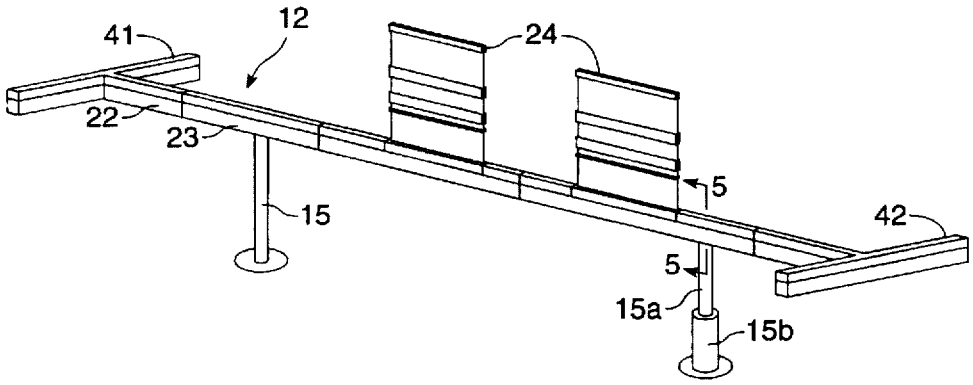
Figure 4B:
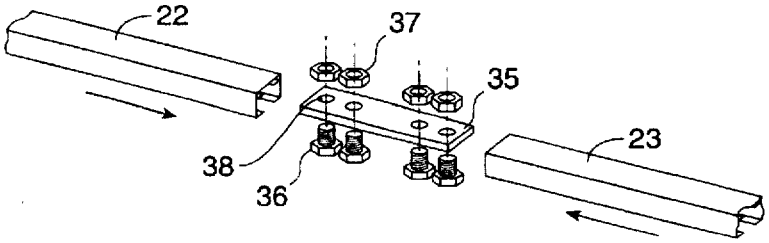
Figure 5:
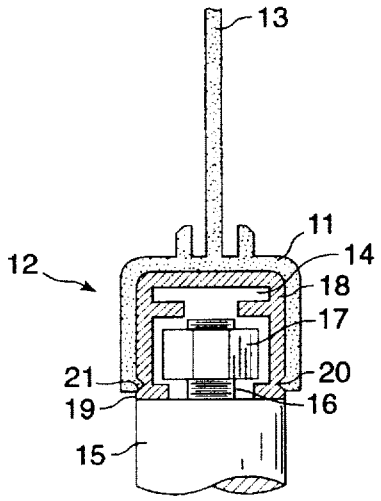
Figure 6A:
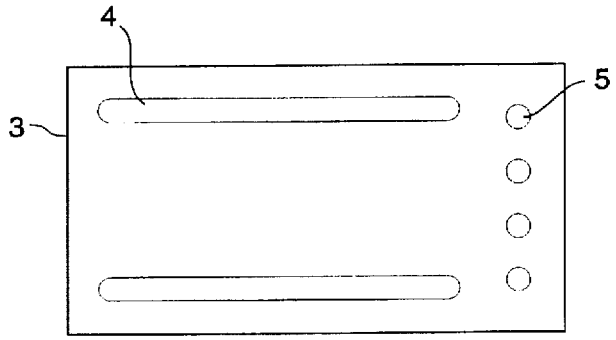
Figure 6B:
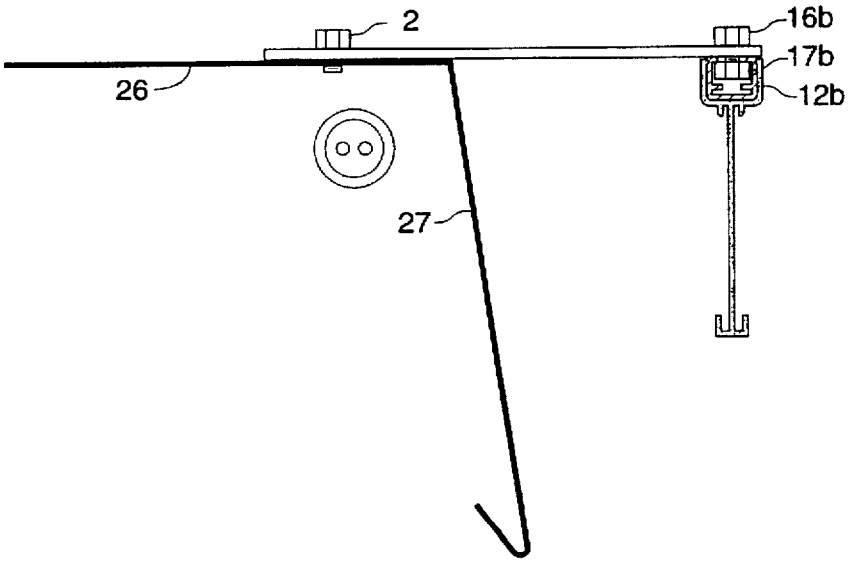

FIG. 4*a* is the signage system of the present invention for use in the stacked produce environment shown in FIG. 2;

FIG. 4*b* is a partial perspective view of means to connect adjacent rail sections of FIG. 4;

FIG. 5 depicts, in detail, means for attaching the signage system of the present invention to an appropriate support; and FIGS. 6*a* and 6*b* are yet another side view of the present invention using a flat bracket in conjunction with the canopied refrigerated case of FIG. 1.

SUMMARY OF THE INVENTION

The present invention relates to a sign system containing one or more rail sections. The rail sections are characterized as having substantially uniform cross-sections and longitudinal axis. Locking means such as indent/protrusion combinations are configured within the rail sections and sign holder bases to maintain the rail sections and sign holder bases in rigid confirmation. The indents substantially align along the longitudinal axis. The cross-sections of each rail section are characterized as having an open region for accepting connector means for connecting one or more rail sections to support means as well as having a body portion for retaining the connector means.

DETAILED DESCRIPTION OF THE INVENTION

Turning first to FIG. 5, a cross-sectional depiction of an important element of the present invention is disclosed. More specifically, rail sections 12 are shown as having indents 20 for accepting complementary protrusion 21 located on sign holder bases 11. Although not shown, the present invention can be practiced by instead provided rail sections with protrusions and holder bases with complimentary indents. Rails 12 consist of one or more rail sections 22, 23, etc. (FIGS. 4*a* and 4*b*) having substantially uniform cross-sections each generally shown in FIG. 5. Adjacent rail sections can be securely connected by using splicer bar 35 together with hex bolts 36 and hex nuts 37 at each joint (FIG. 4*b*). Obviously the nut/bolt combination can be attached to rail sections in a manner similar to the arrangement depicted in FIG. 5. As noted, indents 20 substantially align along the longitudinal axis of individual rail sections 22, 23, etc.

Turning again to FIG. 5, it is noted that each rail section 12 is characterized as having an open region 19 for accepting connector means for connecting said one or more rail sections to support means 15. As a preferred embodiment, the connector means comprise a threaded male member 16 and threaded female member 17 contained within body portion 19. As such, support means 15 can be screwed to rail assembly 12 simply and conveniently. Likewise, by simple loosening of threaded male member 16 and threaded female member 17, support means 15 can be slidably moved along rails 12 as the display environment dictates. In addition, the height of the entire assembly can be varied by employing telescoping support means 15*a* and 15*b* (FIG. 4*a*).

It is contemplated at the terminal ends of the rail sections, particularly in the environment shown in FIG. 4*a*, that T-ends 41 and 42 be employed. The T-ends can be attached to rail sections 22 etc. by use of a modified splicer bar similar to that shown in FIG. 4*b*. The T-ends, which are substantially perpendicular to the main rail sections 22, 23 etc. not only provide a finished "look" to the signage, but also provide support for additional planar channel members 13 if desired.

Although rails 12 are shown in FIG. 4*a* as being supported by the support means 15, under proper conditions, a single support means can be employed. For example an easel base (not shown) can be attached to a single support means as long as the easel base has been stabilized by, for example, the items being sold. Such a configuration is particularly appropriate when displaying a mound of produce such as potatoes or oranges which would rest atop the easel base and stabilize the signage.

There is a further means of providing structural support and rigidity to the sign system; it is noted that rail sections 12 are substantially tubular in cross-section and contain support body 18. The support body is provided with a cross-section as shown in FIG. 5 to snugly fit within and support sign holder base 11. As such, although sign holder base 11 can be removed simply and conveniently by exerting lateral pressure upon planar channel members 13 thus disengaging protrusions 21 from indents 20, when installed, sign holder bases are rigidly secured to the tubular rail section elements 18. It is further appreciated that such a configuration provides the ability to slide the sign holder bases along rail sections so that the appropriate sign can be placed in conjunction with a specific article offered for sale.

The sign system presented herein is further uniquely adaptable for use in conjunction with a refrigerated display case having a canopy. Turning to FIG. **6*b*, canopy 25 is shown as possessing substantially horizontally extending planar top 26 and substantially vertically extending planar face 27. Attachment of rail section 12*b* can be connected to planar top 26 by flat bracket 3 by passing nut/bolt combination 16*b* and 17*b* through holes 5 (FIG. 6*a*). The flat bracket is provided with slots 4 through which a pair of attachment bolts 2 pass. Loosening of bolts 2 will enable the flat bracket to slide over surface 26** and will enable the signage to be variably positioned over the canopy.

Figure 3:
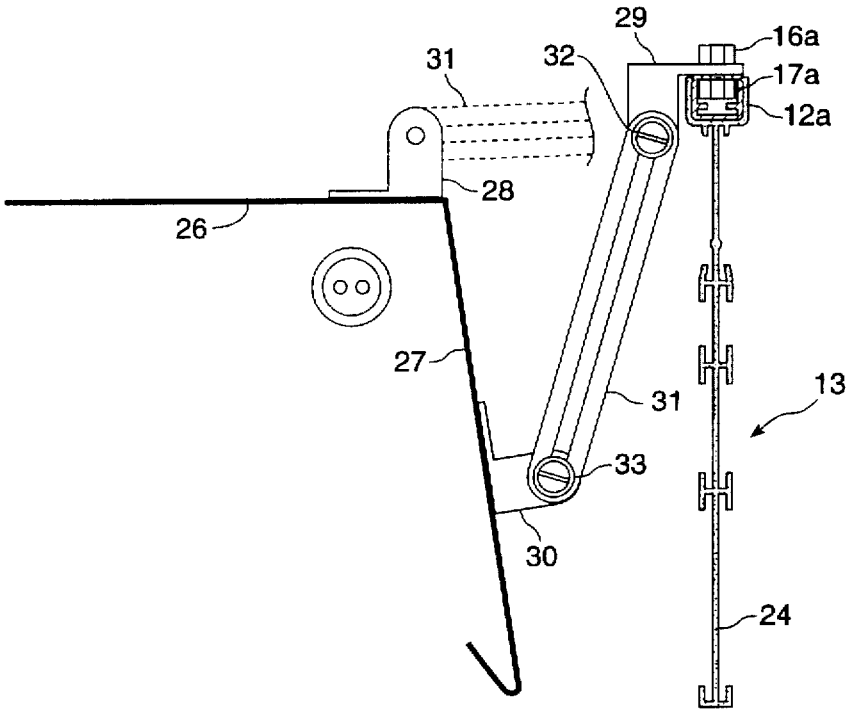
FIG. 3 is a cross-sectional view of the present invention used in conjunction with the canopied refrigerated case of FIG. 1.

In yet a further alternative embodiment of this sign system, rail **12*a* is connected to bracket means 29 (FIG. 3) which can be connected to arm 31 which is, in turn, pivotally connected to second bracket means 30 or 28. These bracket means are attached to either the substantially horizontally or vertically extending planar faces 26 or 27 respectively of canopy 25. In doing so, sign holder base 11** can pivot from the canopy surface to present signing information at an adjustable distance from the customer. Regardless of the rail configuration employed, the same sign holder can be universally used. This greatly enhances the utility of the present invention for users of this device need stock only one form of sign holder whether it is a canopy, easel base or any other type of rail support system.

In each instance, sign holder base 11 is intended to be connected to substantially planar channel members 13. As the name implies, element 13 contains individual channel elements 24 for removably accepting product identifying and pricing information. As such, as product prices routinely change, the sign system of the present invention can remain in place while individual alphanumeric elements can be slidably removed from channels 24 at will.

I claim:

1. A sign system comprising:

a. at least one rail section;

b. connector means;

c. sign holders;

d. sign holder bases; and e. support means, wherein said at least one rail section is characterized as having a substantially uniform cross-section and longitudinal axis wherein the cross-section of each rail section is provided with an open channel for accepting said connector means and indents which align said longitudinal axis of said at least one rail section, the connector means being provided for connecting said at least one rail section to said support means, said sign holder bases being provided with protrusions which create a locking means when engaged with the indents of said at least one rail section wherein said sign holders are removable from said at least one rail section by exerting lateral pressure on said sign holders.

2. A sign system comprising:

a. at least one rail section;

b. connector means;

c. sign holders;

d. sign holder bases; and e. support means, wherein said at least one rail section is characterized as having a substantially uniform cross-section and longitudinal axis wherein the cross-section of each rail section is provided with an open channel for accepting said connector means and protrusions which align said longitudinal axis of said at least one rail section, the connector means being provided for connecting said at least one rail section to said support means, said sign holder bases being provided with indents which create a locking means when engaged with the protrusions of said at least one rail section wherein said sign holders are removable from said at least one rail section by exerting lateral pressure on said sign holders.

3. A sign system comprising:

a. at least one rail section;

b. connector means;

c. sign holders;

d. sign holder bases; and e. support means, wherein said at least one rail section is characterized as having a substantially uniform cross-section and longitudinal axis wherein the cross-section of each rail section is provided with an open channel for accepting said connector means, the connector means being provided for connecting said at least one rail section to said support means, said sign holder bases being sized to frictionally fit said at least one rail section wherein said sign holders are removable from said at least one rail section by exerting lateral pressure on said sign holders.

4. The sign system of claim 3 wherein said support means comprise bracket means for attachment to a surface of a display canopy.

5. The sign system of claim 3 wherein said connector means comprises a threaded male member and a threaded female member contained within said rail section.

6. The sign system of claim 3 wherein at terminal ends of said at least one rail section, further rail sections are provided which are substantially perpendicular to said at least one rail sections.

7. The sign system of claim 3 wherein adjacent rail sections are securely connected together by use of a splicer bar.

8. The sign system of claim 3 wherein said sign holder bases are connected to and support substantially planar channel members, said channel members configured to removably accept product identifying and pricing information.

9. The sign system of claim 8 wherein said sign holder bases are capable of being removed from said at least one rail section by exerting lateral pressure upon a planar channel member.

10. The sign system of claim 3 wherein said sign holder bases are capable of slidably moving along said at least one rail section.

11. The sign system of claim 3 wherein said connector means comprises a threaded male member which is releasably retained in said at least one rail section by a threaded female member which is contained within said at least one rail section.

12. The sign system of claim 3 wherein at terminal ends of said at least one rail section, further rail sections are provided which are substantially perpendicular to said at least one rail section.

13. The sign system of claim 3 wherein adjacent rail sections are securely connected together by use of a splicer bar.

14. The sign system of claim 3 wherein said sign holder bases are connected to and support substantially planar channel members, said channel members configured to removably accept product identifying and pricing information.

15. The sign system of claim 14 wherein said sign holder bases are capable of being removed from said at least one rail section by exerting lateral pressure upon a planar channel member.

16. The sign system of claim 3 wherein said sign holder bases are capable of slidably moving along said at least one rail section.

* * * * *